US009008554B2

(12) United States Patent
Shima

(10) Patent No.: US 9,008,554 B2
(45) Date of Patent: Apr. 14, 2015

(54) TONER SUPPLYING DEVICE

(75) Inventor: Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 579 days.

(21) Appl. No.: 13/115,208

(22) Filed: May 25, 2011

(65) Prior Publication Data

US 2011/0293333 A1 Dec. 1, 2011

(30) Foreign Application Priority Data

May 27, 2010 (JP) ..... 2010-121828

(51) Int. Cl.
*G03G 15/08* (2006.01)

(52) U.S. Cl.
CPC ..... *G03G 15/0839* (2013.01)

(58) Field of Classification Search
CPC ..... G03G 15/0839
USPC ..... 399/258, 252, 260
See application file for complete search history.

(56) References Cited

U.S. PATENT DOCUMENTS

| | | | | |
|---|---|---|---|---|
| 5,310,423 | A * | 5/1994 | Aimoto et al. | 118/689 |
| 7,398,038 | B2 | 7/2008 | Tsuda et al. | |
| 8,204,409 | B2 * | 6/2012 | Ikado | 399/258 |
| 2010/0272476 | A1 | 10/2010 | Shima et al. | |

FOREIGN PATENT DOCUMENTS

| | | | |
|---|---|---|---|
| JP | 3-65970 | A | 3/1991 |
| JP | 5-150654 | A | 6/1993 |
| JP | 2004-139031 | A | 5/2004 |
| JP | 2005-003796 | A | 1/2005 |
| JP | 2007-86332 | A | 4/2007 |
| JP | 2008-275877 | A | 11/2008 |

OTHER PUBLICATIONS

Japanese Office Action dated Jan. 21, 2014, in related Japanese Patent Application No. 2010-121828 (with English translation).

* cited by examiner

*Primary Examiner* — Sandra Brase
(74) *Attorney, Agent, or Firm* — Fitzpatrick, Cella, Harper & Scinto

(57) ABSTRACT

A toner supplying device includes a toner storing portion for storing toner, a toner feeding path in which the toner fed from the toner storing portion is to be fed, and a toner feeding member for feeding the toner in the toner feeding path. An executing portion executes an operation in a filling mode in which the toner is filled in the toner feeding path by intermittently driving the toner feeding member in a preparatory period before image formation.

6 Claims, 8 Drawing Sheets

TONER SUPPLYING DEVICE

FIELD OF THE INVENTION AND RELATED ART

The present invention relates to a toner supplying device for supplying toner from a toner storing portion for storing the toner therein to a developing device.

As an image forming apparatus such as a copying machine, a facsimile machine or a printer, e.g., a constitution in which an electrostatic latent image is formed on an image bearing member such as a photosensitive drum, e.g., an electrophotographic method or an electrostatic recording method and is developed into a visible image (toner image) with a developer (toner) accommodated in the developing device has been known. In this constitution, in the case where the amount of the developer in the developing device is decreased to a predetermined amount or less by developing the electrostatic latent image, a supply developer (toner) for supply is supplied from the toner supplying device into the developing device.

The toner supplying device is constituted by the toner storing portion for receiving the toner supplied from a toner accommodating container in which the supply toner (for supply) is accommodated and a toner feeding path and toner feeding means for feeding (supplying) the toner in the toner accommodating container to the developing device. For example, the toner supplied from the toner accommodating container is dropped by gravitation and accumulated in the toner storing portion, and then is fed by gravitation to an entrance portion of the toner feeding path provided opposed to the bottom of the toner storing portion. Then, the toner in the toner feeding path is supplied to the developing device by the toner feeding means.

In a constitution in which a two-component developer, which is effective in image quality improvement and has an inexpensive running cost, including the toner and a carrier, there is a need to keep a ratio between the amount of the carrier and the amount of the toner in the developing device at a constant level. In this constitution, by adjusting the amount of the toner to be supplied to the developing device by the toner feeding means, the ratio between the carrier amount and the toner amount in the developing device is kept constant. In order to realize stable toner supply by such a toner feeding means, there is a need to stabilize a toner bulk density (toner amount per unit volume) in the toner storing portion and the toner feeding path.

Further, during factory shipment, the image forming apparatus or a cartridge is in a state in which there is no toner in the toner storing portion and the toner feeding path. This is because toner scattering by transportation is avoided and because toner deterioration and agglomeration in the toner storing portion and the toner feeding path by vibration during the transportation are prevented. For these reasons, in the case where a fresh image forming apparatus is first used or during cartridge exchange, the toner accommodating container is mounted in the toner supplying device and then a predetermined preparatory operation (filling operation) for filling the toner in the toner storing portion and the toner feeding path is performed.

The filling operation in the toner supplying device is, in the case where the image is formed after a main assembly disposing operation or a cartridge exchanging operation, performed so that the toner in an amount corresponding to the amount of a consumed developer can be properly supplied. For example, in the case where the toner feeding path is long, even when the toner accommodating container is mounted and the toner is filled in the toner storing portion, an unfilled portion of the toner remains in the toner feeding path. When the image formation is effected while leaving the unfilled portion of the toner, the toner fed from the toner feeding path becomes small with the toner consumption in the developing device until the toner is filled in the toner feeding path. As a result, the toner in the developing device is decreased in amount and thus there is a possibility that an image density is lowered.

The filling of the toner in the toner supplying device is, e.g., performed by obtaining an operation time, of the toner feeding means until the unfilled portion is reliably eliminated, by an experiment in advance and then by driving the toner feeding means for a time corresponding to the obtained operation time. Further, there is a constitution in which a toner content sensor is mounted in the developing device and a toner filling operation is continued until an output of the toner density sensor is produced, and it is judged that the toner supplying device is filled with the toner by the production of the output of the toner density sensor (Japanese Laid-Open Patent Application No. Hei 5-150654).

In recent years, the image forming apparatus is required to realize further image quality improvement and usability improvement. In order to realize the image quality improvement, particularly in the two-component development, it is important that the ratio between the carrier amount and the toner amount in the developing device is kept constant to stabilize the image density. In order to keep the ratio between the carrier amount and the toner amount in the developing device at a constant level, there is a need to control the amount of the toner supplied to the developing device. The supplied toner amount is controlled in the developing device by using a sensor and the toner is quantitatively supplied into the developing device by the toner feeding means, so that the ratio between the carrier amount and the toner amount in the developing device can be kept constant with high accuracy.

However, in order to quantitatively supply the toner by the toner feeding means, the toner bulk density in the neighborhood of an opening (entrance portion) of the toner feeding path into which the toner is fed from the toner storing portion is required to be stabilized to stably feed the toner from the toner storing portion to the toner feeding means. When the toner storing portion and the toner feeding path are filled with the toner, onto the toner in the amount corresponding to the amount of the toner fed to the developing device by the toner feeding means is fed from the toner storing portion to the toner feeding path, so that the toner bulk density in the toner storing portion and in the neighborhood of the opening of the toner feeding means is stabilized.

On the other hand, in the case where the toner supplying device is first used, there is no (or less) toner in the toner feeding path and the toner fed from the toner storing portion to a wide space in the toner feeding path with no (or less) toner is placed in a low-bulk density state. In this state, the toner is carried by the toner feeding means so as to fill the inside of the toner feeding path. However, at this time, when a filling speed is equal to that in the state in which the toner is filled in the toner feeding path, the toner bulk density in the neighborhood of the opening of the toner feeding path is liable to be changed. That is, the toner feeding means feeds the toner in the amount corresponding to the amount of the toner fed into the toner feeding path and therefore the toner feeding means feeds the toner in some cases before the neighborhood of the opening is filled with the toner fed from the toner storing portion to the toner feeding means. As a result, the change in toner bulk density in the neighborhood of the opening of the toner feeding path is liable to occur. Then, the toner bulk density in the toner feeding path is fluctuated, so that variation in the amount of the toner supplied to the developing device is liable to occur.

SUMMARY OF THE INVENTION

In view of the above circumstances, a principal object of the present invention is to provide an image forming apparatus capable of stabilizing a bulk density of toner in a toner feeding path during a preparatory operation for filling the toner in the toner feeding path.

According to an aspect of the present invention, there is provided a toner supplying device comprising:

a toner storing portion for storing toner;

a toner feeding path in which the toner fed from the toner storing portion is to be fed;

a toner feeding member for feeding the toner in the toner feeding path; and an executing portion for executing an operation in a filling mode in which the toner is filled in the toner feeding path by intermittently driving the toner feeding member in a preparatory period before image formation.

According to another aspect of the present invention, there is provided a toner supplying device comprising:

a toner storing portion for storing toner;

a toner feeding path in which the toner fed from the toner storing portion is to be fed;

a toner feeding member for feeding the toner in the toner feeding path; and an executing portion for executing an operation in a filling mode in which the toner is filled in the toner feeding path by driving the toner feeding member so that a driving speed in a preparatory period before image formation is lower than that during the image formation.

These and other objects, features and advantages of the present invention will become more apparent upon a consideration of the following description of the preferred embodiments of the present invention taken in conjunction with the accompanying drawings.

Figure 6:
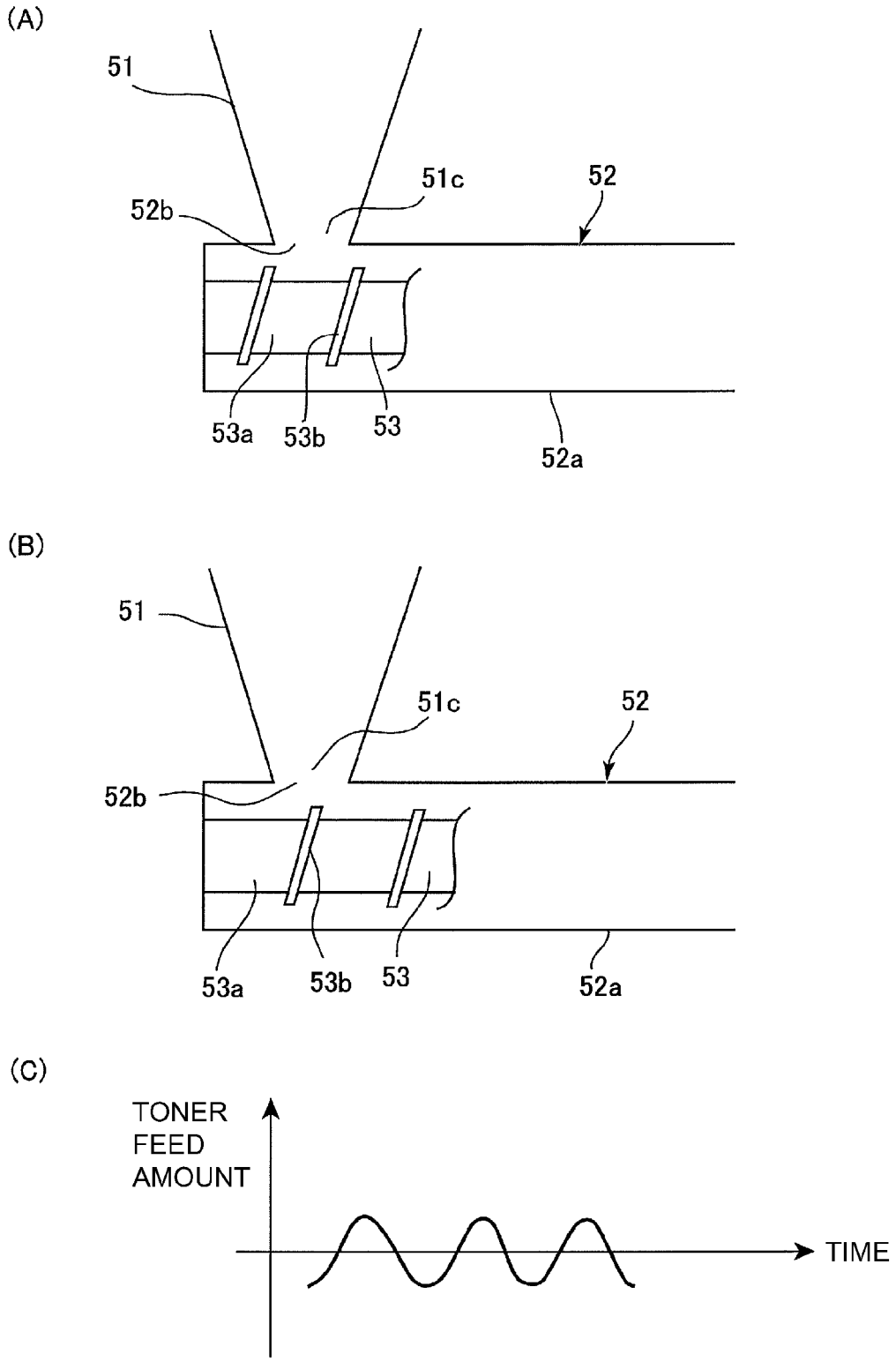

Parts (A), (B) and (C) of FIG. 6 are schematic views for illustrating pulsation in an intermittent operation.

Figure 7:
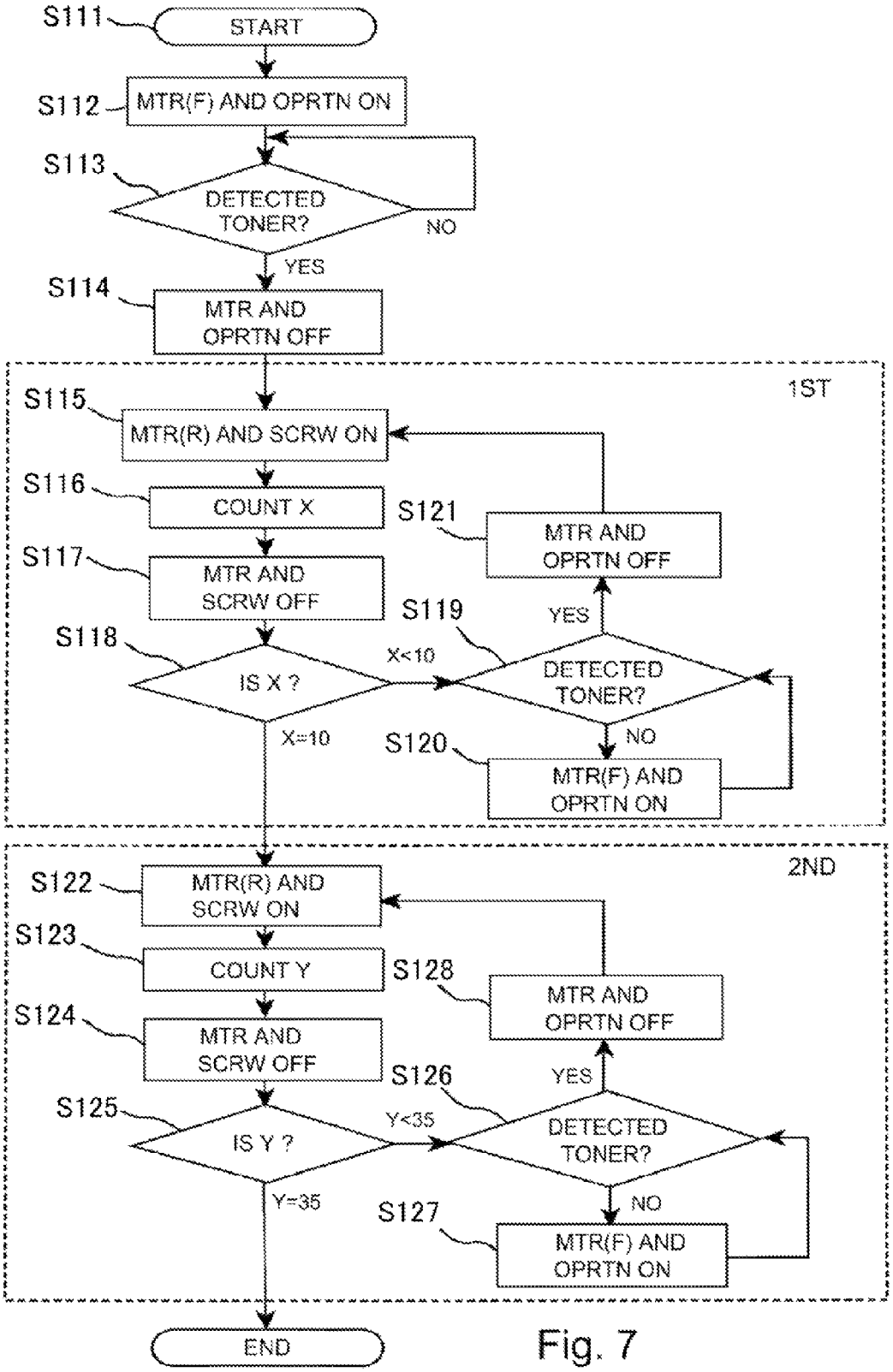

FIG. 7 is a flow chart showing a flow of a toner filling mode in a Second Embodiment.

Figure 8:
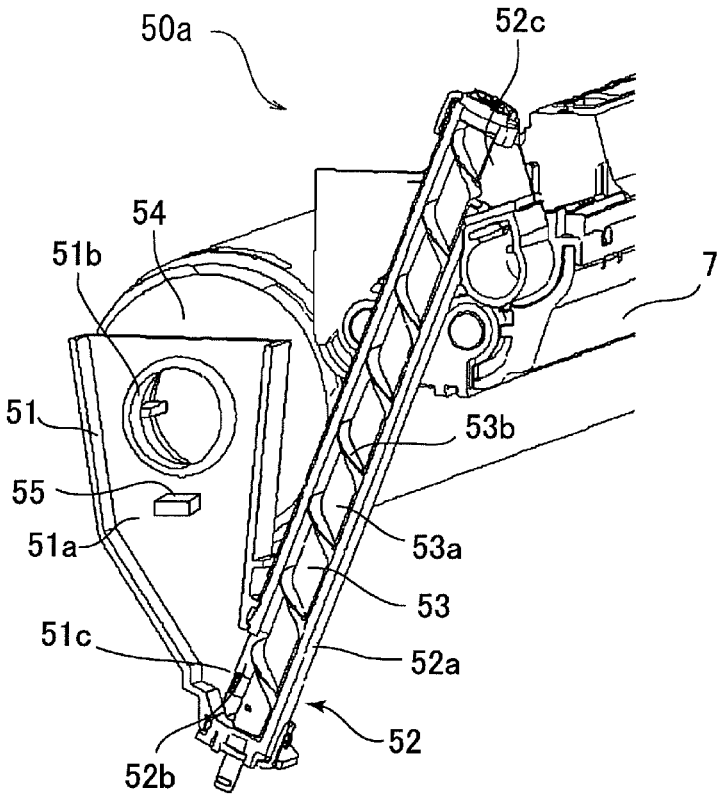

FIG. 8 is a partly cut-away perspective view showing a toner supplying device in a Third Embodiment.

DESCRIPTION OF THE PREFERRED EMBODIMENTS

First Embodiment (Image Forming Apparatus and Cartridge)

Figure 1:
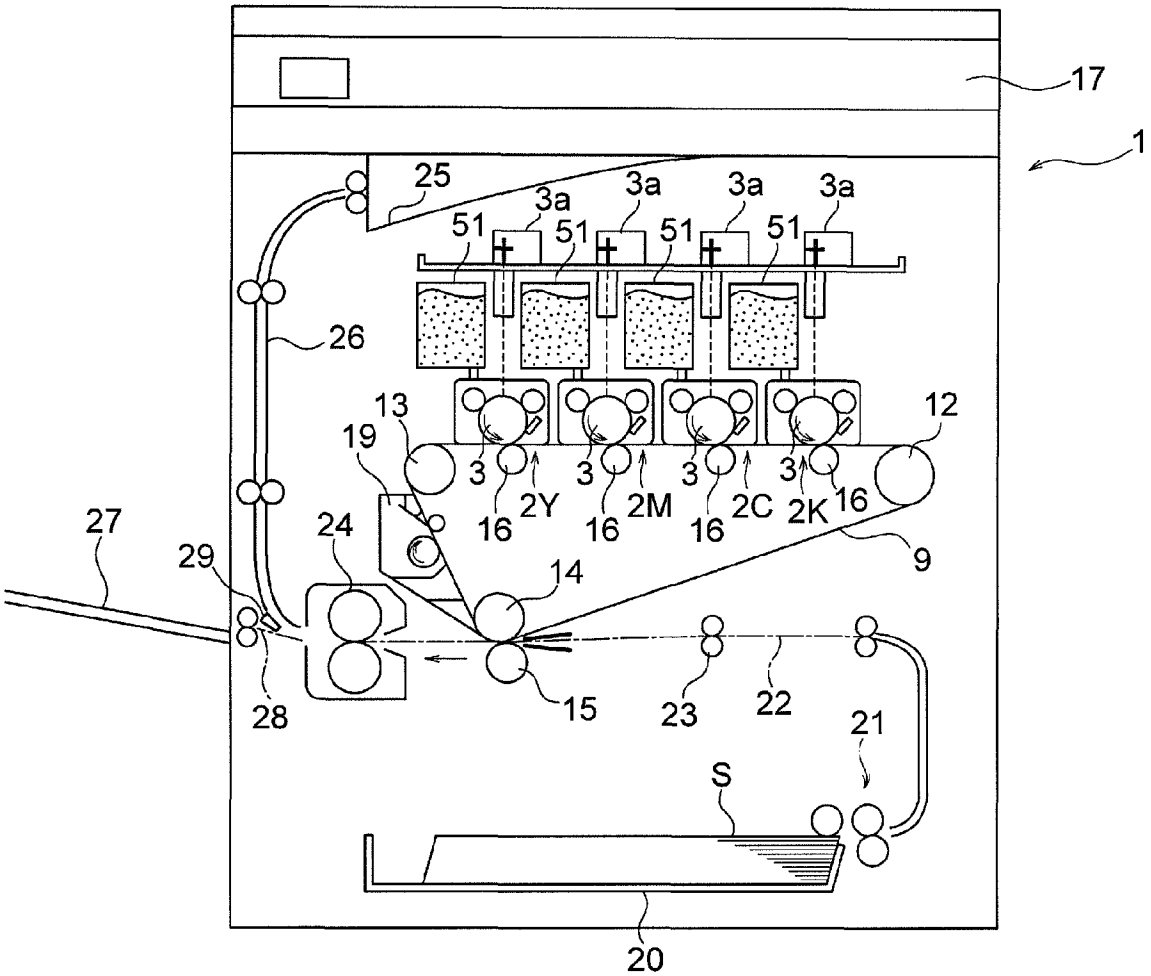
FIG. 1 is a schematic illustration of an example of an image forming apparatus according to the present invention.
Figure 2:
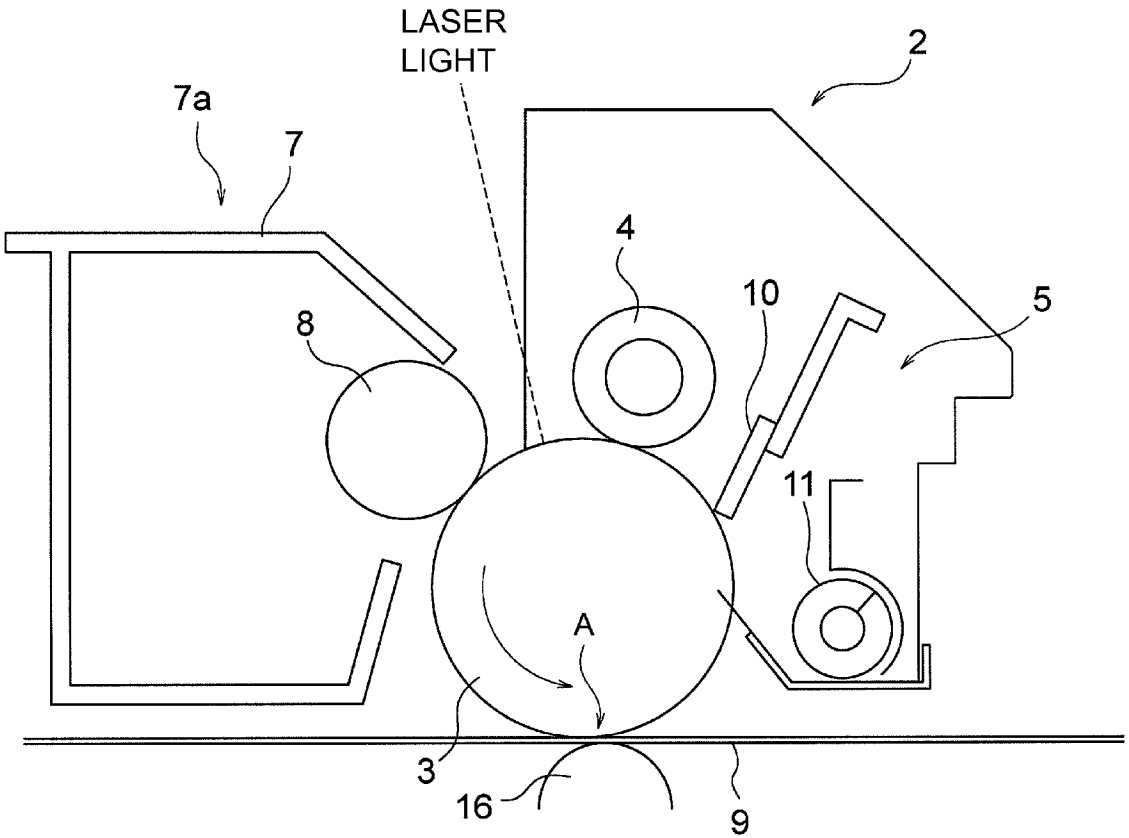
FIG. 2 is a schematic illustration of an example of a cartridge in the present invention.

A First Embodiment of the present invention will be described with reference to FIGS. 1 to 5. First, a general structure of an image forming apparatus and cartridge in this embodiment will be described with reference to FIGS. 1 and 2. In this embodiment, the present invention is applied to a tandem type color image forming apparatus. As shown in FIG. 1, at an upper portion of an inside of an image forming apparatus main assembly (apparatus main assembly) 1, four cartridges 2Y, 2M, 2C and 2K for four colors of yellow (Y), magenta (M), cyan (C) and black (K) are disposed. FIG. 2 shows a single cartridge 2 which is one of the cartridges shown in FIG. 1. The cartridge 2 includes a photosensitive drum 3 which is an image bearing member, and around the photosensitive drum 3, a charging roller 4 which is a charging means and a cleaning device 5 and the like are disposed.

In this embodiment, the photosensitive drum 3, the charging roller 4, the cleaning device 5 and the like are integrally assembled into the cartridge 2 (drum cartridge), and a developing device different in life time from such a drum cartridge is separately assembled into a toner cartridge 7*a*. However, the cartridge 2 may also be assembled with the developing device 7 so as to be connectable to and disconnectable from the developing device 7, thus being assembled into a so-called process cartridge.

In either case, around the photosensitive drum 3, with respect to a rotational direction of the photosensitive drum 3 during printing (direction indicated by an arrow in FIG. 2), the charging roller 4, an exposure portion for exposing the photosensitive drum 3 to laser light or the like, the developing device 7, a transfer portion A and the cleaning device 5 are disposed in this order. Further, on the developing device 7, a toner supplying device 50 which will be described later is mounted. The developing device 7 including the toner supplying device 50 constitutes the toner cartridge 7*a* or the process cartridge. The cartridge is detachably mountable to the apparatus main assembly 1.

The photosensitive drum 3 is formed in a cylindrical shape and, after being uniformly charged by the charging roller 4, is irradiated at its surface with the laser light (indicated by broken lines in FIGS. 1 and 2) from an exposure device 3*a* (FIG. 1), so that an electrostatic latent image is formed on the surface of the photosensitive drum 3. The developing device 7 supplies the toner, supplied from a toner accommodating container 54 (FIG. 3) described later into a toner storing portion 51, from a developing sleeve 8 onto the surface of the photosensitive drum 3 on which the electrostatic latent image is formed, so that the electrostatic latent image is developed with the toner into a toner image. The toner accommodating container 54 supplies the toner depending on a toner consumption amount so that each of the color toner amounts in the toner storing portion 51 is not below a predetermined amount.

The cleaning device 5 includes a cleaning blade 10 for removing the toner, after the toner image is primary-transferred from the develop 3 onto an intermediary transfer belt 9, remaining on the surface of the photosensitive drum 3. Further, the cleaning device 5 also includes a filling screw 11 which is a collected toner filling means for filling the toner, collected by the cleaning blade 10, to a collected toner container or the like in the apparatus main assembly 1.

Further, the cartridge 2 and the toner cartridge 7*a*, or the process cartridge can be inserted and mounted into a predetermined portion in the apparatus main assembly 1 and also can be demounted from the apparatus main assembly 1. Thus, the cartridge 2 or the like is detachably mountable to the apparatus main assembly 1, so that maintenance and exchange of consumables are facilitated to remain a product performance. That is, when the image forming apparatus is used for a long time, various parts are exhausted to deteriorate a print quality but a service person or a user removes the cartridge 2 or the like and performs maintenance or exchange of the removed cartridge 2 or the like, so that a predetermined performance can be maintained.

At a lower side of the cartridges 2 in the apparatus main assembly 1, as shown in FIGS. 1 and 2, the intermediary transfer belt 9 is rotatably stretched. That is, the intermediary transfer belt 9 is formed in an endless belt shape and as shown in FIG. 1, is stretched by a driving roller 12, a tension roller 13 and an inner secondary transfer roller 14. The driving roller 12 is driven by an unshown motor and rotates the intermediary transfer belt 9. The tension roller 13 applies predetermined tension to the intermediary transfer belt 9 by an unshown urging means to adjust the tension of the intermediary transfer belt 9, so that bending or the like of the intermediary transfer belt 9 due to a change in load is prevented. The inner secondary transfer roller 14 is disposed opposed to an outer secondary transfer roller 15 and transfers the toner images from the intermediary transfer belt 9 onto a recording material. Further, at positions inside the intermediary transfer belt 9, each of primary transfer rollers 16 are disposed opposed to the associated photosensitive drum 3 to constitute the transfer portion A where the toner image formed on the photosensitive drum 3 is to be transferred onto the intermediary transfer belt 9.

In the case where an original is printed, on the basis of image data read by an original reader 17 or sent from an external terminal, the charged developed is irradiated with the laser light, so that the electrostatic latent image is formed (written) on the photosensitive drum 3. Then, the toner is supplied by the photosensitive drum 7 onto the photosensitive drum 3 on which the electrostatic latent image is formed to form the toner image. Then, the toner image is primary-transferred onto the intermediary transfer belt 9 by the primary transfer roller 16. At this time, a predetermined transfer bias is applied to the primary transfer portion, so that the toner image is transferred from the photosensitive drum 3 onto the intermediary transfer belt 9. The toner images primary-transferred on the intermediary transfer belt 9 are secondary-transferred, at a secondary transfer portion constituted by the inner and outer secondary transfer rollers 14 and 15, onto the recording material S conveyed by a recording material conveying means. The toner remaining on the intermediary transfer belt 9 without being transferred at the secondary transfer portion is collected by a transfer belt cleaner 19.

The recording material conveying means conveys the recording material S from a sheet feeding cassette 20 to the secondary transfer portion. That is, the recording material S picked-up from the sheet feeding cassette 20 is conveyed from a sheet feeding portion 21 along a conveying path 22 toward a downstream side with respect to a conveyance direction. By a registration roller pair 23, final correction of oblique movement of the recording material S and adjustment of timing between the image writing at the image forming portion and the recording material conveyance are effected. Then, with predetermined timing, the recording material S is conveyed to the secondary transfer portion. The toner image transferred on the recording material S is fixed on the recording material S by a fixing device 24. The recording material S is, after passing through the fixing device 24, conveyed to a sheet discharging path 26 along which the recording material S is discharged onto a (face-down) sheet discharge tray 25 or to a sheet discharging path 28 along which the recording material S is discharged onto a (face-up) sheet discharge tray 27. At a branch point between the sheet discharging paths 26 and 28, the two conveying paths are switched by a switching means 29, so that the printed recording material S is discharged on the sheet discharge tray 25 or 27.

(Toner Supplying Device)

Figure 3:
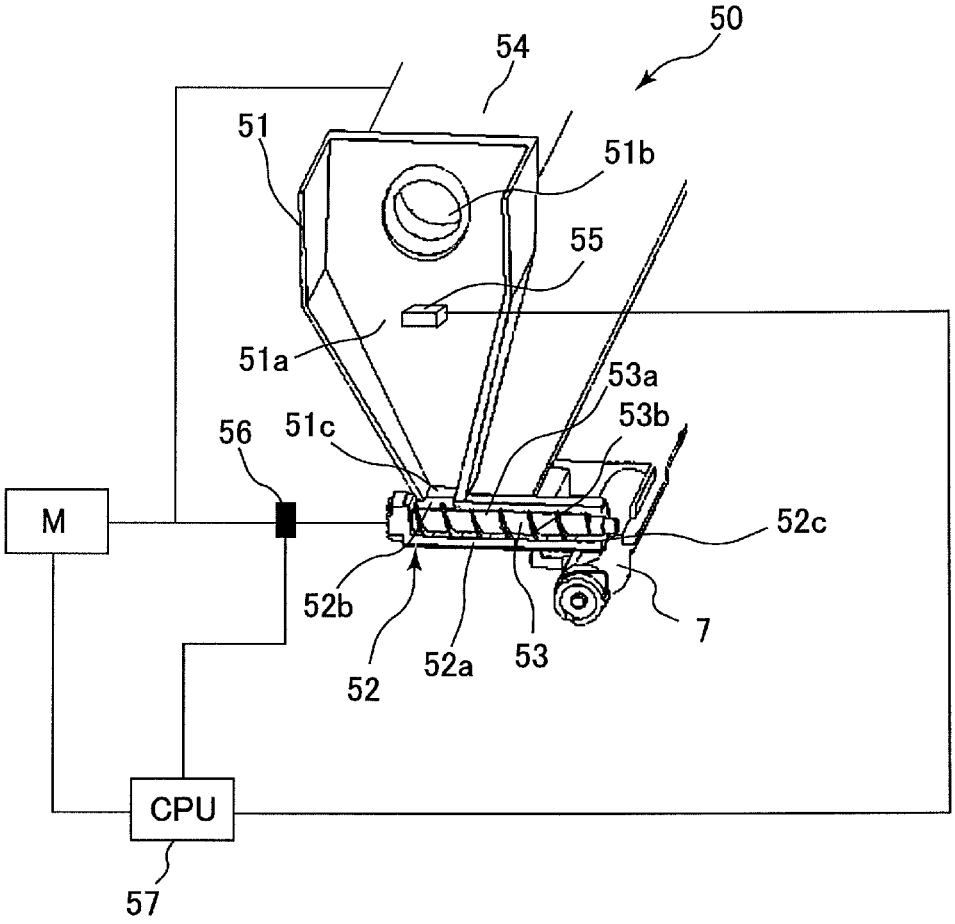
FIG. 3 is a partly cut-away perspective view showing a toner supplying device in First Embodiment.
Figure 4:
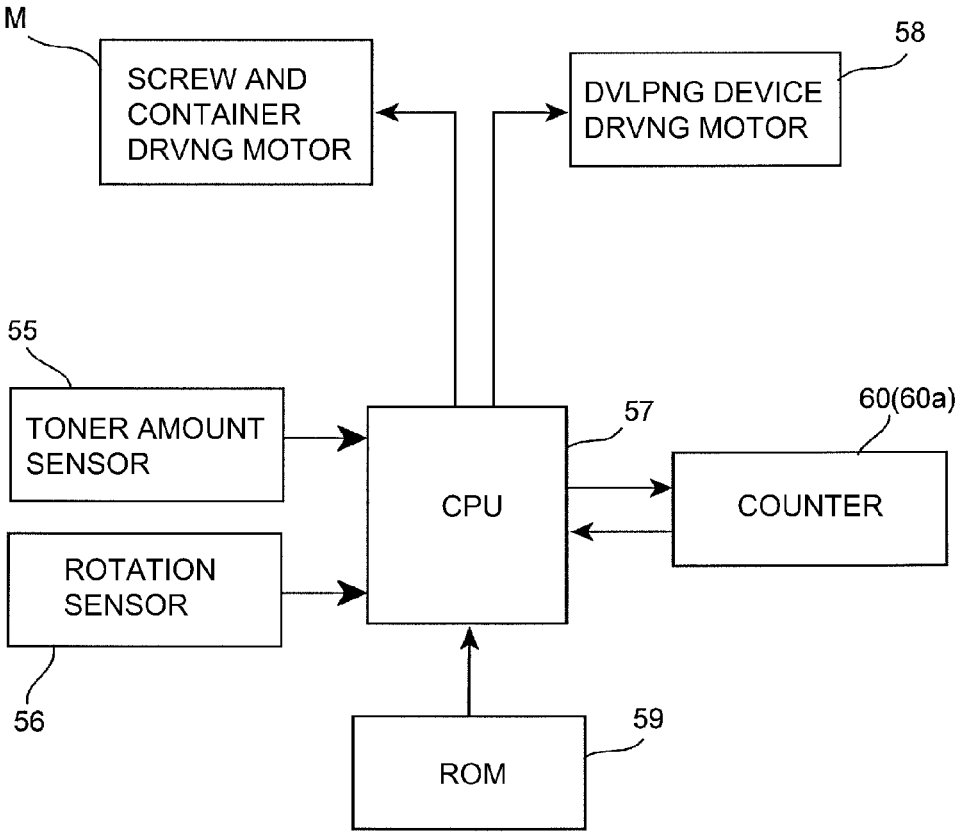
FIG. 4 is a block diagram for illustrating control in a First Embodiment.

Next, the toner supplying device 50 for supplying the toner to the developing device 7 will be described with reference to FIGS. 3 and 4. The toner supplying device 50 includes the toner storing portion 51, a toner feeding path 52 and a screw 53 as a toner feeding means. The toner storing portion 51 includes a storing space 51*a* surrounded by a wall and the toner is stored in the storing space 51*a*. The toner storing portion 51 is provided with an entrance opening 51*b* at its upper side surface and an end of the toner accommodating container 54 is connected to the entrance opening 51*b*.

At a predetermined position of the toner storing portion 51, a toner amount detecting sensor 55 is disposed and detects whether or not the toner in a predetermined amount is stored in the toner storing portion 51 (storing space 51*a*). The toner amount detecting sensor 55 may be a means, such as a piezoelectric element or an optical sensor including a light emitting portion and a light receiving portion, which is capable of detecting the toner at a position in which the sensor is disposed.

The toner accommodating container 54 is formed in, e.g., a cylindrical shape and is provided with an openable cover at its one end. The cover is opened in a state in which the toner accommodating container 54 is mounted on the toner supplying device 50. Then, in the open state of the cover, the entrance opening 51*b* provided in the toner storing portion 51 communicates with the inside of the toner accommodating container 54. Further, the toner accommodating container 54 is rotatable by a motor M and by its rotation, the toner in an amount corresponding to the rotation is fed (conveyed) from the entrance opening 51*b* into the storing space 51*a*. Thus, the toner is supplied from the toner accommodating container 54 into the storing space 51*a* and is stored in the storing space 51*a*.

Further, the storing space 51*a* of the toner storing portion 51 is constituted so as to narrow in space from a vertical intermediate portion to a lower end portion, and the lower end portion of the toner storing portion 51 is provided with a discharge opening 51*c*. Therefore, the toner stored in the storing space 51*a* is fed to the discharge opening by gravitation or along the inner wall surrounding the storing space 51*a*.

Further, the toner feeding path 52 is constituted by a cylindrical feeding container 52*a*. The feeding container 52*a* is disposed below the toner storing portion 51 and is provided with an entrance opening 52*b*, as a toner carrying-in portion, at one end-side upper portion opposing the discharge opening 51*c*. Further, the discharge opening 51*c* of the toner storing portion 51 and the entrance opening 52*b* of the toner feeding path 52 are connected to each other. As a result, the toner is fed (conveyed) by gravitation into the feeding container 52 through the discharge opening 51*c* and the entrance opening 52*b*. On the other hand, the feeding container 52 is provided with a discharge opening 52*c*, as a toner supplying portion, at the other end side thereof. Therefore, the toner in the toner feeding path 52 passes, through the intermittent of the feeding container 52*a*, between the entrance opening 52*b* and the discharge opening 52*c*. The discharge opening 52*c* is connected to the developing device 7.

Further, the screw 53 includes a shaft 53*a* and a blade disposed helically around the shaft 53*a* and is disposed inside the feeding container 52*a*. The shaft 53*a* is connected to a rotation shaft of the motor M for rotating the toner accommodating container 54, so that the screw 53 is rotated by the motor M. That is, in the case where the motor M is rotated (forward rotation) in a predetermined direction, the toner accommodating container 54 is rotated, and in the case where the motor M is rotated (reverse rotation) in a direction opposite from the predetermined direction, the screw 53 is rotated. For this purpose, one-way clutch is provided at an intermediate position of each of rotation transmission paths, so that only a rotational force in one direction is transmitted.

Thus, when the single motor M for driving the toner accommodating container 54 and the screw 53 is used, a disposing space of the motor M can be reduced and thus it becomes possible to reduce the size and cost of the image forming apparatus. Further, the toner accommodating container 54 and the screw 53 are separated driven, so that a small output motor can be used as the motor M, so that the downsizing and cost reduction can be further improved. Incidentally, each of the toner accommodating container 54 and the screw 53 may also be provided with a (single) driving motor.

In either case, when the screw 53 is rotated by the motor M, the toner is fed from the entrance opening 52*b* to the discharge opening 52*c* in the toner feeding path 52. Then, the toner is supplied to the developing device 7 through the discharge opening 52*c*.

During a normal operation (during image formation), i.e., in a state in which the toner is filled in the toner storing portion 51 and the toner feeding path 52, the toner is supplied from the toner accommodating container 54 in the following manner. First, when the toner amount detecting sensor 55 detects that there is no toner, the toner accommodating container 54 is rotated to supply the toner into the toner storing portion 51. Then, when the toner amount detecting sensor 55 detects that the toner is present, the rotation of the toner accommodating container 54 is stopped and thus the toner supply is stopped. As a result, the toner in a predetermined amount is supplied into the toner storing portion 51. Incidentally, it is also possible to employ a constitution in which a driving time, of the toner accommodating container 54, necessary to supply the toner in the predetermined amount into the toner storing portion 51 is determined in advance by an experiment without providing the toner amount detecting sensor 55 and then the toner accommodating container 51 is driven for the determined time.

Further, the screw 53 feeds the toner through the toner feeding path 52 depending on the amount of use of the toner in the developing device 7. That is, the screw 53 is rotated so that the toner can be supplied to the developing device 7 in an amount corresponding to that of the toner used in the developing device 7. In this embodiment, a rotation detecting sensor 56 for detecting the rotation of the screw 53 is provided, so that the number of rotations of the screw 53 is detectable by the rotation detecting sensor 56. Therefore, the toner in a proper amount can be supplied to the developing device 7 by rotating the screw 5 in a predetermined number of rotations corresponding to the amount of use of the toner in the developing device 7.

Various driving means and sensors are operated in accordance with instructions provided from CPU 57 as a control means. As shown in FIG. 4, the CPU 57 is connected with a screw and toner accommodating container driving motor M, a developing device driving motor 58, the toner amount detecting sensor 55, the rotation detecting sensor 56, ROM 59 in which programs for executing various types of control, and a counter 60. Here, the developing device driving motor 58 drives a feeding means or the like for feeding the toner in the developing device 7. Further, the counter 60 counts a time as described later.

Further, the CPU 57 controls the screw 53 in the following manner. That is, a toner feeding amount per unit time is made smaller, in the case where the toner is fed a state (unfilled state) in which there is an unfixed portion of the toner in the toner feeding path 52, than that in the case where the toner is fed in a state (filled state) in which the toner is filled in the toner feeding path 52. Specifically, during a preparatory operation for filling the intermittent of the toner feeding path 52 with the toner, the screw 53 is controlled so that the toner feeding amount per unit time is smaller than that during the image formation. In other words, an average of the toner feeding speed in the unfilled state is made smaller than that in the filled state. In this embodiment, control for lowering a rotational speed of the screw 53 is effected. For example, the rotational speed in the unfilled state may preferably be set at a value which is ½ or less, more preferably ¼ or less, of the rotational speed in the filled state.

Figure 5:
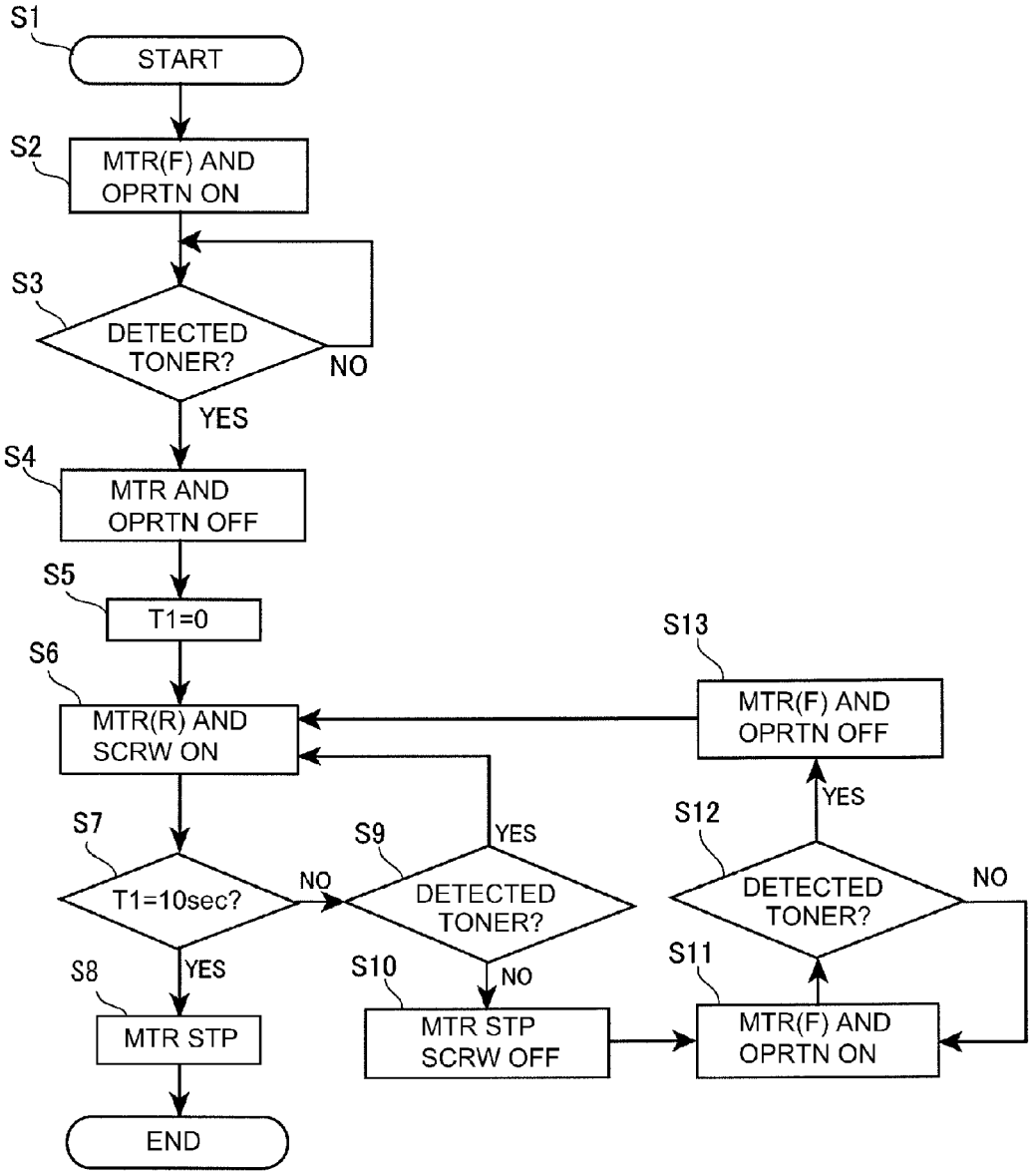
FIG. 5 is a flow chart showing a flow of a toner filling mode in the First Embodiment.

This point will be described also with reference to FIG. 5. In the state in which the image forming apparatus is first mounted or in the state in which the toner cartridge 7*a* or the process cartridge is exchanged, the toner storing portion 51 and the toner feeding path 52 are in the no toner state. Therefore, the user or a service engineer starts an operation in a toner filling mode by selecting the toner filling mode by an operation through an unshown operating portion (S1). Then, the toner amount detecting sensor 55 does not detect the toner and therefore the CPU 57 drives the motor M (forward rotation) to start toner supply from the toner accommodating container 54 to the toner storing portion 51 (toner accommodating container operation: ON) (S2). At this time, the screw 53 is not driven, so that the toner is stored in the toner storing portion 51.

The toner supply to the toner storing portion 51 is continued until the toner amount detecting sensor 55 detects the toner (S3). In the case where the toner amount detecting sensor 55 detects the toner, the drive of the toner accommodating container 54 is stopped (operation: OFF), so that the toner supply from the toner accommodating container 54 to the toner storing portion 51 is temporarily stopped (S4).

Then, time T=0 is inputted by the counter 60 (S5) and thereafter in order to fill the toner in the toner feeding path 52, the motor M is rotated in the direction opposite from that in the above case to drive the screw 53 (operation: ON) (S6). At the same time, the counter 60 starts counting. Then, whether or not T1 reaches a predetermined value of, e.g., 10 seconds is judged (S7). In the case where T1 does not reach 10 seconds, the following operation is repeated. First, the presence or absence of the toner in the toner storing portion 51 is detected by the toner amount detecting sensor 55 (S9). In the case where the toner is not detected, the motor M is stopped to stop the operation of the screw 52 (operation: OFF) (S10).

Next, the motor is rotated (forward rotation) to drive the toner accommodating container 54 (operation: ON) (S11), so that the toner is supplied from the toner accommodating container 54 to the toner storing portion 51. This supplying operation is continued until the toner amount detecting sensor 55 detects the presence of the toner (S12). In this case, during the operation of the toner accommodating container 54, the time T1 is not counted. When the toner amount detecting sensor 55 detects the presence of the toner, the drive of the motor M is stopped to stop the operation of the toner accommodating container 54 (operation: OFF) (S13). Then, the operation is returned to S6, and the counting is resumed and the screw 53 is driven by reversely rotating the motor M. In S7, when T1 reaches 10 seconds, the drive of the motor M is stopped (S8) to stop the drive of the screw. Thus, the toner filling mode is ended.

In this embodiment, in the operation in such a toner filling mode (during the preparatory operation), the operational speed of the screw 53 is lowered so that the toner feeding amount per unit time is smaller than that during the normal operation. For this purpose, the rotational speed of the motor M is made lower than that during the normal operation. As a result, in the operation in the toner filling mode, a bulk density of the toner at the entrance opening 52*b* as a toner transfer portion between the toner storing portion 51 and the toner feeding path 52 can be stabilized.

That is, during the normal operation, between the toner storing portion 51 and the toner feeding path 52, the toner is caused to be pushed by gravitation from the toner storing portion 51 into the toner feeding path 52. However, the intermittent of the toner feeding path 52 is filled with the toner and therefore the toner between the toner storing portion 51 and the toner feeding path 52 is pushed into the toner feeding path 52 in a state in which predetermined pressure is exerted on the toner, so that the bulk density of the toner in the neighborhood of the entrance opening 52*b* is stabilized.

On the other hand, in the state in which there is no toner in the toner feeding path 52, the toner supplied from the toner storing portion 51 into the toner feeding path 52 enters a sufficient (unfilled) space, so that the toner bulk density in the neighborhood of the entrance opening 52*b* is in a low state. In this state, the toner is carried by the screw 53 so as to fill the inside of the toner feeding path 52. Correspondingly to the amount of the toner filled in the toner feeding path 52, the toner is carried by the screw 53 and therefore the amount of the toner carried by the screw 53 is larger than the amount of the toner fed from the toner storing portion 51 into the toner feeding path 52. Then, in this state, when the feeding operation is continued, the toner bulk density in the toner feeding path 52 is also in the low state.

When the operation of the screw 53 is further continued, the toner is gradually filled in the toner feeding path 52, so that the toner feeding amount of the screw 53 is equal to the pushing-in amount of the toner from the toner storing portion 51. In other words, the toner is fed from the toner storing portion 51 in the amount corresponding to the amount of the toner fed by the screw 53. Thus, the bulk density of the toner between the toner storing portion 51 and the toner feeding path 52 is gradually stabilized. Until the bulk density is stabilized, the toner cannot be quantitatively supplied to the developing device 7, so that a fluctuation in toner content in the developing device 7 is liable to occur. On the other hand, when the operation in the toner filling mode is continued until the bulk density is stabilized, the toner is supplied in a large amount into the developing device 7 and thus the toner content in the developing device 7 is increased.

Therefore, the toner feeding amount per unit time of the screw 53 is lowered, so that the toner feeding means of the screw 53 is made smaller than the amount of the toner fed from the toner storing portion 51. As a result, a sufficient time is ensured for pushing the toner from the toner storing portion 51 into the toner feeding path 52, so that the toner bulk density at the transfer portion between the toner storing portion 51 and the toner feeding path 52 can be stabilized early. As a result, after the operation in the filling mode is ended, the toner can be quantitatively supplied to the developing device 7 and thus the toner content in the developing device 7 can be stabilized, thus leading to image quality improvement. Further, the toner is not excessively supplied into the developing device 7.

Modified Embodiment of First Embodiment

In order to reduce an operation time of the toner filling mode, it is also possible to gradually increase the toner feeding amount per unit time from the unfilled state of the toner in the toner feeding path to the filled state of the toner in the toner feeding path. That is, an initial operation, necessary at the time of disposing the apparatus main assembly or exchanging the cartridge, such as filling of the toner is performed by the user in many cases and its operation time may desirably be short. However, in the case where the toner feeding amount per unit time of the screw 53 is equal to that during the normal operation, the toner filling time is prolonged. This is because the toner filling operation is required to be continued until the amount of the toner supplied to the developing device 7 is stabilized, i.e., until the above-described fluctuation in toner bulk density is converted.

On the other hand, in the First Embodiment, the toner feeding amount of the screw 53 is lowered for a predetermined time and therefore it is imperative to take time to some extent in the operation in the toner filling mode. Accordingly, when the toner feeding amount of the screw 53 is gradually increased, the time taken for performing the operation in the toner filling mode can be reduced. For example, the rotational speed of the screw 53 is set in a first predetermined time at 25% of that in a normal state, in a subsequent second predetermined time at 50% of that in the normal state and then in a third predetermined time at 75% of that in the normal state. Alternatively, the rotational speed of the screw 53 may also be increased continuously for a predetermined time. In either case, the toner feeding amount by the screw 53 is gradually increased and therefore the toner is filled in the toner feeding path early, so that the time required for performing the operation in the toner filling mode can be reduced.

In a state in which the toner is charged in the toner feeding path to some extent, the toner bulk density is to be stabilized and therefore there is no problem even in the constitution in which the toner feeding amount is gradually increased.

Second Embodiment

The Second Embodiment of the present invention will be described with reference to FIGS. 7 and 7 in combination with FIGS. 3 and 4. In this embodiment, the toner supplying device 50 is different from that in First Embodiment in that the toner filling by the screw 53 is effected by an intermittent operation. Other structures and functions are similar to those in the First Embodiment and therefore the difference will be principally described.

In this embodiment, the CPU 57 performs an intermittent rotation operation of the screw 53 in the toner filling mode and controls an interval of the intermittent rotation operation. That is, the rotation operation is performed every one rotation at a predetermined interval. Further, in this embodiment, the rotation of the screw 53 is controlled so that the screw 53 is located at the same rotational position every one rotation. That is, the CPU 57 controls, on the basis of a detection result of the rotation detecting sensor 56, the interval so that the rotation of the screw 53 is stopped at the same position by the intermittent rotation operation.

This will be described with reference to FIG. 6. The screw 53 feeds the toner in the amount corresponding to one pitch by one rotation but by the influence of a positional relationship of the blade 53*b* relative to the entrance opening 52*b*, the image forming apparatus pulsates and repeats an increase and a decrease during one rotation. That is, as shown in (A) of FIG. 6, in the case where a space between the entrance opening 52*b* and the screw 53 is increased by, e.g., deviation of the blade 53*b* from an opposing position to the entrance opening 52*b*, the amount (toner feeding amount) of the toner fed through the entrance opening 52*b* is increased. On the other hand, as shown in (B) of FIG. 6, in the case where the space between the entrance opening 52*b* and the screw 53 is narrowed by, e.g., the presence of the blade 53 at the opposing position to the entrance opening 52*b*, the amount of the toner fed through the entrance opening 52*b* is decreased. As a result, as shown in (C) of FIG. 6, by the rotation of the screw 53, the amount (toner feeding amount) of the toner fed through the entrance opening fluctuates, i.e., pulsates.

In this embodiment, in order that the intermittent rotation operation is not readily affected by the pulsation, the screw 53 is always rotated on one rotation basis, so that the position of the blade 53*b* of the screw 53 relative to the entrance opening 52*b* can be the same. Incidentally, in this embodiment, the counter 60*a* (FIG. 4) counts the number of rotations of the screw 53. That is, on the basis of the detection result of the rotation detecting sensor 56, the counter 60*a* counts the number of rotations.

The flow of such an operation in the toner filling mode in this embodiment will be described with reference to FIG. 7. First, the user or the like starts the operation in the toner filling mode by, e.g., selecting the toner filling mode (S111). Then, the toner amount detecting sensor 55 does not detect the toner and therefore the CPU 57 drives the motor M (forward rotation) to start toner supply from the toner accommodating container 54 to the toner storing portion 51 (S112). At this time, the screw 53 is not driven, so that the toner is stored in the toner storing portion 51.

The toner supply to the toner storing portion 51 is continued until the toner amount detecting sensor 55 detects the toner (S113). In the case where the toner amount detecting sensor 55 detects the toner, the drive of the toner accommodating container 54 is stopped (operation: OFF), so that the toner supply from the toner accommodating container 54 to the toner storing portion 51 is temporarily stopped (S114).

Then, (rotation number)=0 is inputted by the counter 60*a* and thereafter in order to fill the toner in the toner feeding path 52, the motor M is rotated in the direction opposite from that in the above case to drive the screw 53 (S115). Then, the counter 60*a* counts the rotation number X (S116) and the motor M stops the rotation every one rotation of the screw 53 (S117). This series of motions is performed at a predetermined interval and in a predetermined number of time, e.g., at an interval of 2 seconds and in 10 times.

Then, whether or not the number of times reaches 10 times is judged (S118). In the case where the number of times does not reach 10 times, the following operation is repeated. First, the presence or absence of the toner in the toner storing portion 51 is detected by the toner amount detecting sensor 55 (S119). In the case where the toner is not detected, the motor M is driven to feed the toner from the toner accommodating container 54 into the toner storing portion 51 until the presence of the toner is detected (S120). When the presence of the toner is detected, the motor M is stopped (S121) and the operation is returned to S115.

Here, the series of the operations from S115 to S121 is performed every one rotation. In the case where the toner is not detected in S119, the interval of the intermittent rotation operation of the screw 53 is longer than a set value (e.g., 2 seconds) but when the toner presence is detected in S119, there is no toner feeding operation from the toner accommodating container 54 and thus the intermittent rotation operation of the screw 53 can be performed at the set value. Incidentally, the above-described predetermined interval is measured by a timer provided in the image forming apparatus (or may also be provided in the counter 60*a*).

The above-described operation such that the intermittent rotation operation is performed 10 times at the interval of 2 seconds is referred to as first filling, a sufficient interval of the intermittent rotation operation is ensured in order to stabilize the toner bulk density at the transfer portion between the toner storing portion 51 and the toner feeding path 52. At that time, by performing the intermittent rotation operation and ensuring the sufficient interval, the toner feeding amount per unit time of the screw 53 is made lower than that during the normal operation.

Thereafter, in the case where the number of times reaches 10 times, the operation enter second filling. Also in the second filling, the screw 53 is driven (S122). The counter 60*a* counts the rotation number Y (S123) and the motor M stops the rotation every one rotation of the screw 53 (S124). This series of motions is performed at a predetermined interval and in a predetermined number of time, e.g., at an interval of 0.5 second and in 35 times. Then, whether or not the number of times reaches 35 times is judged (S125). In the case where the number of times does not reach 35 times, the following operation is repeated. First, the presence or absence of the toner in the toner storing portion 51 is detected by the toner amount detecting sensor 55 (S126). In the case where the toner is not detected, the motor M is driven to feed the toner from the toner accommodating container 54 into the toner storing portion 51 until the presence of the toner is detected (S127). When the presence of the toner is detected, the motor M is stopped (S128) and the operation is returned to S122.

Also in the second filling, the series of the operations from S122 to S128 is performed every one rotation. Incidentally, in the case where the toner is not detected in S126, the interval of the intermittent rotation operation of the screw 53 can be longer than a set value (e.g., 0.5 second). However, when the toner presence is detected in S126, there is no toner feeding operation from the toner accommodating container 54 and thus the intermittent rotation operation of the screw 53 can be performed at the set value. In either case, the operation in the toner filling mode is ended at the time when the count of the rotation number Y reaches 35 times.

Here, the reason why the interval of the intermittent rotation operation in the second filling is made shorter than that in the first filling is that a total time of the operation in the toner filling mode is reduced. The preparatory operation, during the disposition of the image forming apparatus, such as the operation in the toner filling mode keeps the user waiting as it takes a longer time, thus being undesirable. Setting of the total time of the operation filling mode at a small value also leads to improvement in usability. As described above, the toner bulk density at the transfer rotation between the toner storing portion 51 and the toner feeding path 52 is placed in the stable state by the first filling. For this reason, in the second filling, the toner is not completely filled in the toner feeding path 52 as yet but is filled at the transfer portion and therefore the toner can be charged in the stable toner bulk density state even when the toner feeding interval is not increased different from the case of the first filling. Therefore, in the second filling, the longer operation interval of the screw 53 as in the case of the first filling is not required and thus the operation interval can be decreased. Incidentally, in this embodiment, in order to fill the toner in a final space of the inside of the toner feeding path 52, the rotation number of the screw 53 is determined so that the toner can be somewhat discharged to the developing device 7. That is, the toner filled by the first filling is somewhat discharged to the developing device 7. However, the amount of the discharged toner is slight and therefore, the toner content fluctuation in the developing device 7 is of no problem.

As described above, in this embodiment, in the toner filling mode, the toner is filled in the toner feeding path 52 while lowering the toner feeding amount per unit time, so that the toner bulk density at the transfer portion between the toner storing portion 51 and the toner feeding path 52. As a result, the toner supply amount to the developing device 7 from after the operation in the toner filling mode is ended can be stabilized, and the toner content in the developing device 7 from after the apparatus main assembly is disposed can be stabilized, thus contributing to the image quality improvement. Further, from the state in which the toner feeding amount per unit time in the toner filling mode is lowered, the time required for the operation in the toner filling mode can be reduced by gradually increasing the toner feeding amount, thus improving the usability.

Incidentally, in this embodiment, the operation in the toner filling mode may also be performed only by the first filling by omitting the second filling. Further, the toner feeding amount by the screw 53 may be increased by further increasing the number of filling operations such as third filling, fourth filling, and the like.

Third Embodiment

A Third Embodiment of the present invention will be described with reference to FIG. 8. In this embodiment, in the toner feeding path 52 of a toner supplying device 50*a* in the disposed state, the entrance opening 52*b* as the toner carrying-in portion is located below the discharge opening 52*c* as the toner supplying portion. For this purpose, the feeding container 52*a* constituting the toner feeding path 52 is disposed in an inclined state with respect to the horizontal direction. Further, the discharge opening 51*c* of the toner storing portion 51 is provided at a lower side portion of the toner storing portion 51 and is connected to the entrance opening 52*b* of the toner feeding path 52. Further, the screw 53 is disposed in the feeding container 52*a* and feeds the toner, sent through the entrance opening 52*b*, obliquely upward. Then, the toner is supplied to the developing device 7 through the discharge opening 52*c*.

In this embodiment, the toner is fed, in the toner feeding path 52 obliquely upward and thus the toner bulk density between the toner storing portion 51 and the toner feeding path 52 is less liable to be stabilized. For this reason, compared with the embodiments described above, the toner bulk density is required to be further stabilized. Therefore, similarly as the above-described embodiments, by the operation in the toner filling mode, the toner feeding amount per unit time of the screw 52 is lowered. Other structures and functions are similar to those in the above-described embodiments.

Incidentally, in the embodiments described above, the case where the present invention is applied to the image forming apparatus including the toner cartridge or the process cartridge is described. However, the direction is not limited thereto and is also applicable to other various types of image forming apparatuses. Further, the present invention is applicable to a constitution in which a two-component developer consisting of the toner and a carrier is used and a constitution in which a one-component developer consisting only of the toner.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 121828/2010 filed May 27, 2010, which is hereby incorporated by reference.

What is claimed is:

1. An image forming apparatus comprising:

a toner storing portion for storing a toner;

a toner feeding path in which the toner fed from said toner storing portion is to be fed;

a toner feeding member for feeding the toner in said toner feeding path;

a developing device for effecting development with the toner fed from said toner feeding path; and a controller capable of executing, in a preparatory period before image formation, an operation in a filling mode in which the toner is filled in said toner feeding path by driving said toner feeding member, wherein the operation in the filling mode includes an operation in a first mode in which said toner feeding member is driven under a first condition in which a drive amount per unit time is smaller than a drive amount per unit time during normal image formation and an operation in a second mode in which said toner feeding member is driven, after the operation in the first mode is executed, under a second condition in which a drive amount per unit time is larger than the drive amount per unit time in the operation in the first mode.

2. An apparatus according to claim 1, wherein each of the first mode and the second mode is a mode in which said toner feeding member is intermittently driven in an intermittent operation, and wherein said controller effects control so that a stop time of said toner feeding member in the intermittent operation is shorter in the second mode than in the first mode.

3. An apparatus according to claim 1, wherein each of the first mode and the second mode is a mode in which said toner feeding member is continuously driven, and wherein said controller effects control so that a rotational speed of said toner feeding member is higher in the second mode than in the first mode.

4. An apparatus according to claim 1, wherein said toner feeding path includes an upward feeding path, connected to a side of said toner storing portion, for feeding the toner upward with respect to a gravitation direction.

5. An apparatus according to claim 1, further comprising an operating portion where a signal for executing the operation in the filling mode is to be inputted, and wherein said controller executes the operation in the filling mode on the basis of the signal inputted from said operating portion.

6. An apparatus according to claim 1, further comprising a sensor for detecting information on an amount of the toner in said toner storing portion, and wherein during the operation in the filling mode, said controller executes, on the basis of an output of said sensor, an operation in a mode in which the operation in the toner filling mode is interrupted and then the toner is supplied to said toner storing portion.

* * * * *